United States Patent [19]

Focke

[11] Patent Number: 4,662,624

[45] Date of Patent: May 5, 1987

[54] APPARATUS FOR MAINTAINING A SUFFICIENT STOCK OF BLANKS FOR A PACKAGING MACHINE

[75] Inventor: Heinz Focke, Verden, Fed. Rep. of Germany

[73] Assignee: Focke & Co. (GmbH & Co.), Fed. Rep. of Germany

[21] Appl. No.: 683,099

[22] Filed: Dec. 18, 1984

[30] Foreign Application Priority Data

Jan. 26, 1984 [DE] Fed. Rep. of Germany ..... 3402514

[51] Int. Cl.[4] ..... B65H 1/26

[52] U.S. Cl. ..... 271/157; 221/104; 271/162; 414/115

[58] Field of Search ..... 271/3.1, 162, 163, 164, 271/9, 189, 218, 157, 158, 159; 414/32, 115; 221/11, 296, 298, 104, 106

[56] References Cited

U.S. PATENT DOCUMENTS

| | | | |
|---|---|---|---|
| 1,976,892 | 10/1934 | Shomaker | 271/164 |
| 3,543,956 | 12/1970 | Furuno | 414/917 |
| 3,591,018 | 7/1971 | Nalbach | 271/3.1 |
| 3,929,326 | 12/1975 | Seragnoli | 271/3.1 |

*Primary Examiner*—F. J. Bartuska

*Attorney, Agent, or Firm*—Sughrue, Mion, Zinn, Macpeak, and Seas

[57] ABSTRACT

To maintain a sufficient stock of blanks (10) in packaging machines, especially for hinge-lid packs to receive cigarettes, there is a magazine (11) with a plurality of magazine shafts (13, 14, 15), from which a stock of blanks (16) is extracted successively in the region of an extraction station (12). A residual stock (23) of blanks is constantly maintained in the extraction station (12), while the magazine (11) is displaced after a magazine shaft (13, 14, 15) has been emptied.

10 Claims, 8 Drawing Figures

APPARATUS FOR MAINTAINING A SUFFICIENT STOCK OF BLANKS FOR A PACKAGING MACHINE

DESCRIPTION

The invention relates to an apparatus for the packaging of articles, especially cigarettes, into blanks of packaging material which are extracted from a magazine and fed to folding members.

The blanks processed in a packaging machine can either be severed continuously from a sheet of packaging material in the region of the packaging machine or be introduced as finished blanks into a blank magazine of the packaging machine. The invention is concerned with the latter solution which is used, above all, in the production of packs from relatively thick packaging material, preferably thin cardboard. In the production of hinge-lid packs for cigarettes, prestamped blanks arranged in stacks are used in practice.

In high-performance packaging machines, the demand for blanks per unit of time is relatively high. Consequently, an important problem is to guarantee that blanks will be provided in sufficient quantity. Since the stocks of blanks can only be limited, a further important concern is to supply the folding members of the packaging machine continuously with blanks, even when these are delivered in batches.

The object on which the invention is based, in a packaging machine with a magazine for receiving blanks stacked on top of one another, is to guarantee a high magazine capacity and continuous uninterrupted supply to the folding members.

To achieve this object, the magazine assigned to the packaging machine is formed from several part magazines (magazine shafts) which each receive a stock of blanks (blank stack) and which can be fed in succession to a (common) extraction station.

The magazine preferably consists of several, especially three, vertical magazine shafts arranged next to one another, in each of which a substantial stock of blanks is received and which can be moved above the extraction station as the result of a common transverse movement. A particular magazine shaft is always located in the extraction station, so that the stock of blanks can be extracted at the bottom according to consumption.

A further essential feature of the invention is that a residual stock of blanks is constantly maintained in the extraction station for the magazine and can be topped up as a result of the emptying of a magazine shaft. As soon as the magazine shaft located in the extraction station is emptied, a full magazine shaft is moved into a position above the residual stock, whilst at the same time blanks continue to be extracted from the residual stock. The content of the magazine shaft is then lowered as a result of a downward movement until it has topped up the residual stock or until it joins the latter, so that a quantity of blanks formed from the residual stock and the content of the magazine shaft is available.

In the region of the extraction station, the stock of blanks in the magazine shafts open at the bottom is supported by a retractable supporting member (supporting finger). By means of this supporting member, the stock of blanks in the magazine shaft is lowered until it comes to rest on the residual stock.

The magazine as a single unit, consisting of several magazine shafts, and the supporting member in the region of the extraction station are driven by means of special mechanical gears, in such a way that the movements are synchronized exactly. Accordingly, further features of the invention relate to the gears for the magazine and supporting member (supporting finger) and to the constructional design of the magazine and of the abovementioned supporting member.

An exemplary embodiment of the invention is explained below with reference to the drawings in which.

Figure 1:
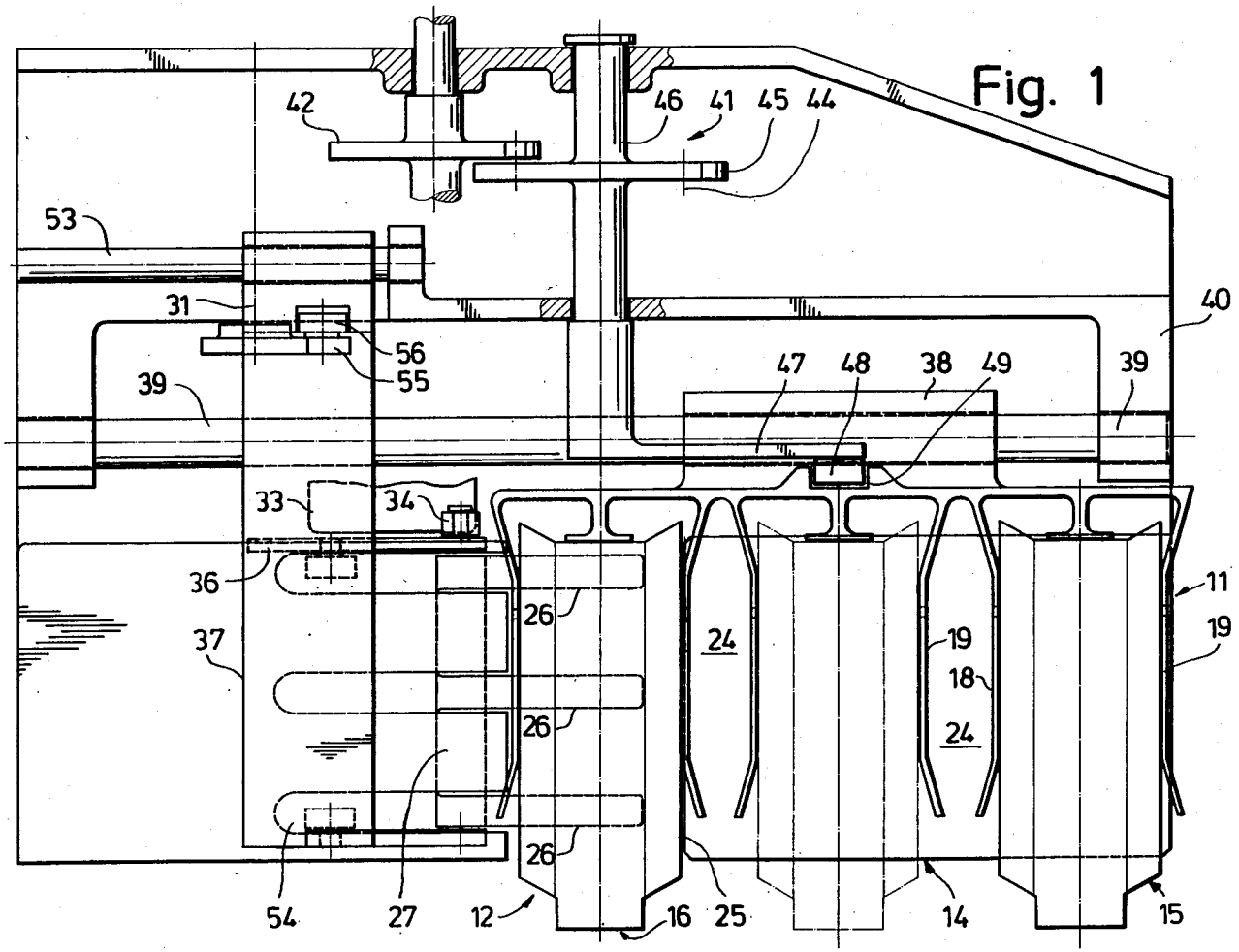
FIG. 1 shows the magazine together with the gear in a horizontal projection.

The apparatus illustrated in the drawings is part of a packaging machine, in the present case for the production of hinge-lid packs for receiving cigarettes. The individual hinge-lid packs are folded from blanks 10. These in turn are manufactured (outside the packaging machine) and are introduced in large stacks into the packaging machine, in particular into a magazine 11. Individual blanks 10 are extracted from this in succession in the region of an extraction station 12 and fed to suitable known packaging members.

In the present exemplary embodiment, the magazine 11 consists of several, namely three, part magazines in the form of magazine shafts 13, 14 and 15. Each of these is intended for receiving a stock of blanks 16, in particular a stack of blanks 10 resting on top of one another. The magazine shafts 13, 14 and 15 are combined into a common magazine 11 and attached to a continuous rear wall 17. Each magazine shaft 13, 14, 15 is limited by side walls 18 and 19 which diverge from one another in the form of a funnel towards the open front side of the magazine shafts and towards the rear wall 17. Opposite the rear wall 17, the stocks of blanks 16 are each supported by a vertical spacer strip 20. The magazine shafts 13, 14 and 15 are open on the front side located opposite the rear wall 17 and at the top and bottom. It is consequently easy to fill them with blanks 10 and extract these.

A particular magazine shaft 13, 14, 15 is always located in the extraction station 12. Located in this, underneath the magazine 11 and at a distance from it, is a suitable blank-extraction unit, in particular a transfer roller 21 of known design and operation. This is moveable to and fro in the longitudinal direction of the blanks, and the particular blank located at the bottom is taken from the stack or the stock of blanks 16 and can be fed to a discharge conveyor, in the present case two conveyor rollers 22.

In the region of the extraction station 12, a certain minimum residual stock 23 of blanks 10 is constantly maintained. This residual stock 23 is located underneath the magazine 11. The particular magazine shaft 13, 14, 15 located in the extraction station 12 supplements the residual stock 23 by supplying the stock of blanks 16 in the respective magazine shaft.

The magazine 11 is moveable as a single unit, in particular displaceable transversely in an essentially horizontal plane, in such a way that there is always one of the magazine shafts 13, 14, 15 located in the region of the extraction station 12 above the residual stock 23. Outside the region of the extraction station 12, the magazine 11 is arranged and is moveable above a magazine table 24. The magazine table 24 is located directly underneath the magazine 11, in such a way that the latter is displaceable relative to the magazine table 24, but the stock of blanks 16 is retained in the magazine shafts 13, 14, 15 open at the bottom. In the region of the extraction station 12, the magazine table 24 is provided with a recess 25. This makes it possible to extract the stock of blanks 16 from or lower it in the magazine shaft located in the region of the extraction station 12.

Figure 3:
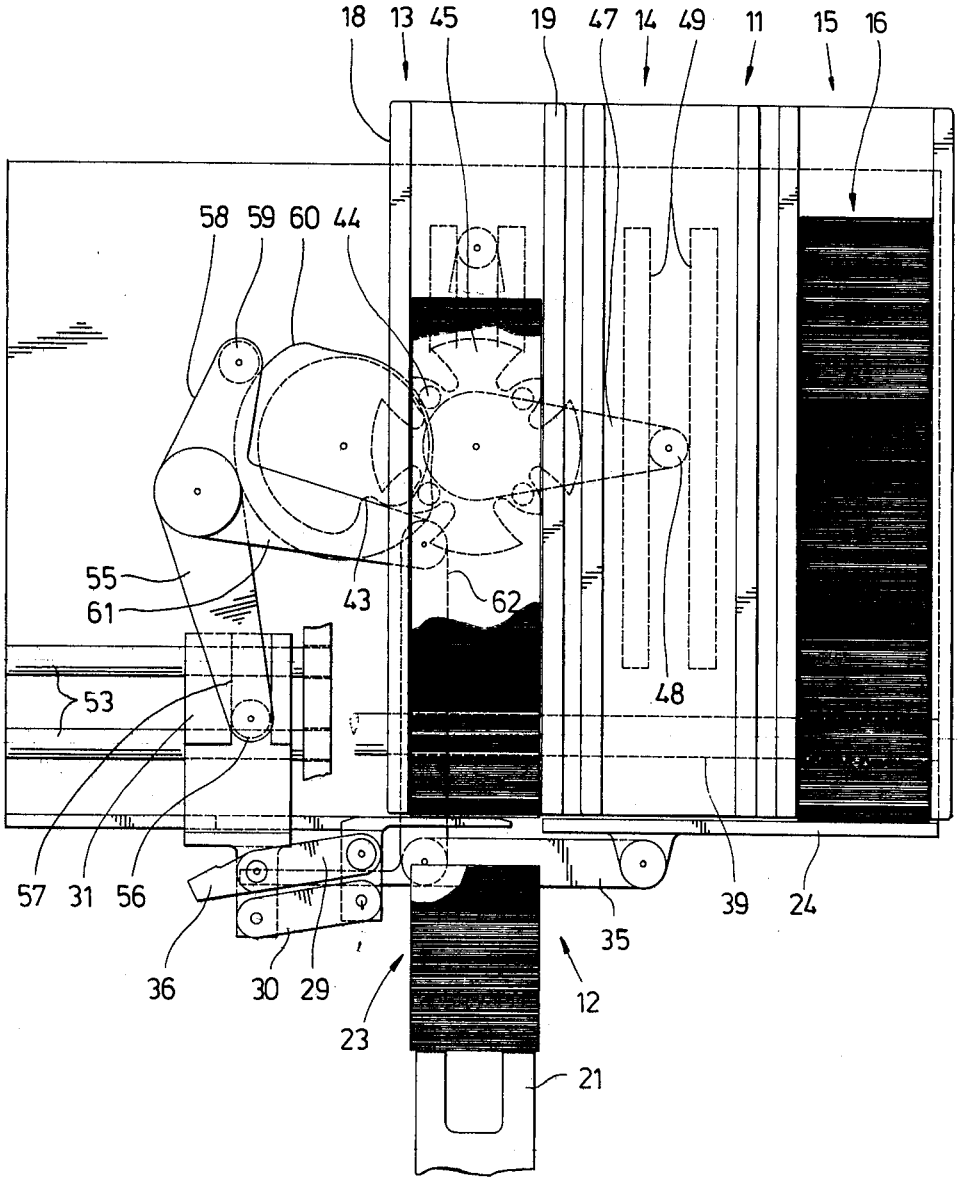
FIG. 3 shows a front view of the magazine.

In the region of the extraction station 12, the stock of blanks 16 in the magazine shaft located in the extraction station 12 is temporarily prevented from being lowered by means of a moveable supporting member. In the present case, this moveable supporting member consists of several (three) supporting fingers 26. These penetrate into the region of the recess 25 from the side at a distance from one another, specifically transversely to the longitudinal extension of the blanks 10. The latter or the stock of blanks 16 rest on the supporting ends of the supporting fingers 26. To empty the magazine shaft 13, 14, 15 located in the extraction station 12 or to lower the stock of blanks 16 onto the residual stock 23, the supporting fingers 26 are retracted from the supporting position (FIG. 3).

Figure 7:
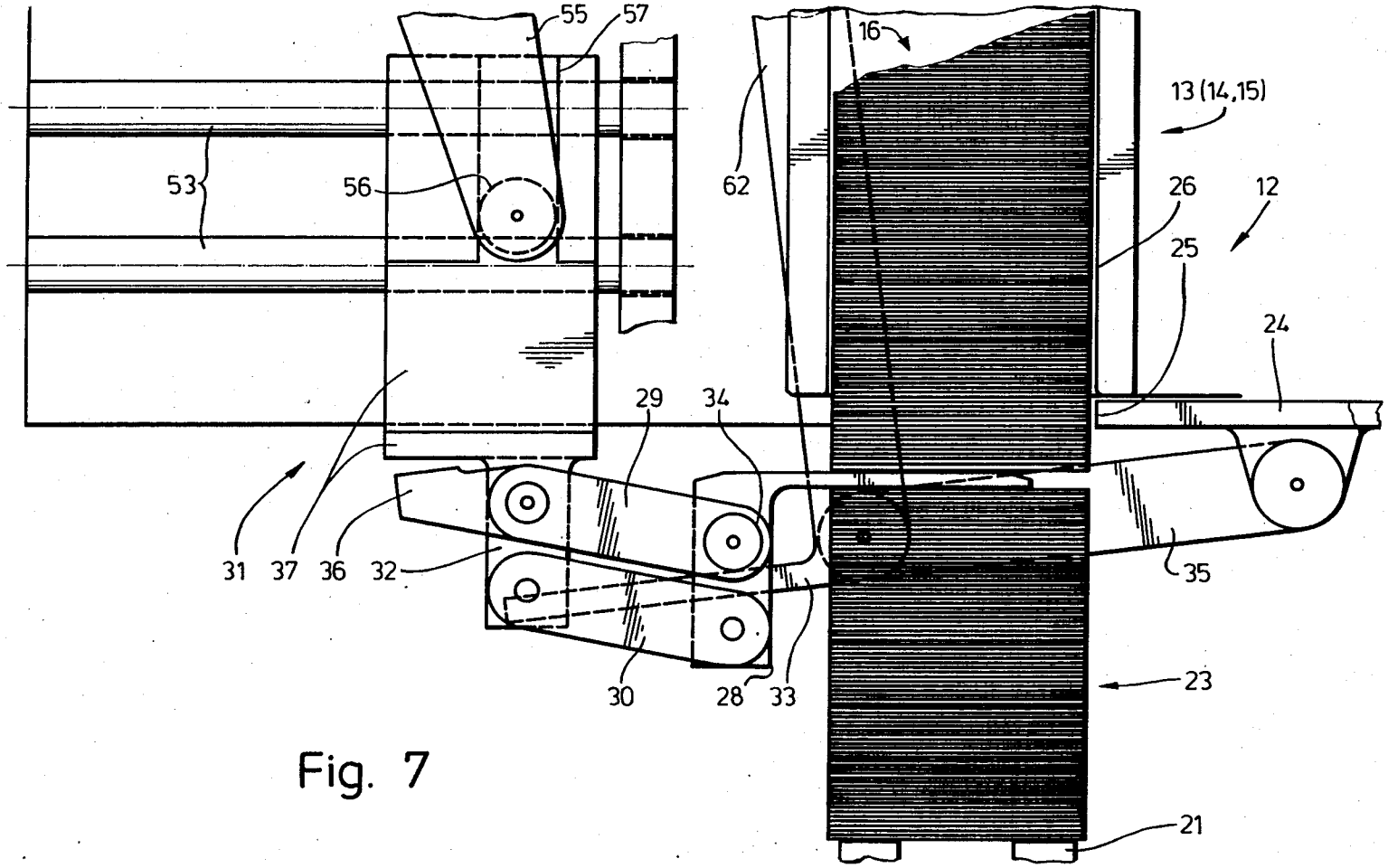
FIG. 7 shows a side view of the lower part of a magazine shaft on an enlarged scale.
Figure 8:
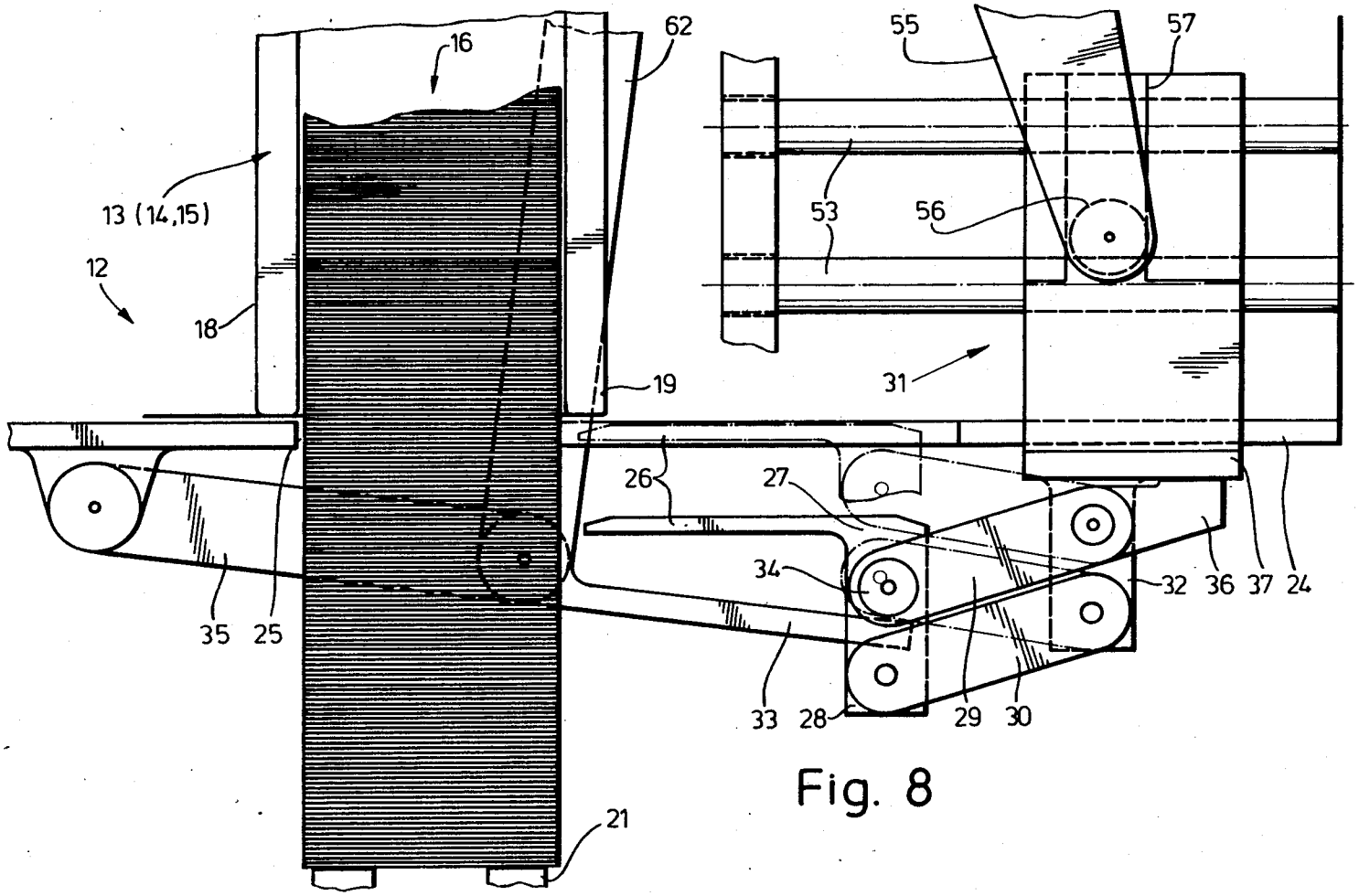
FIG. 8 shows a representation corresponding to that of FIG. 7, with a changed relative position of auxiliary parts.

As is evident from FIGS. 7 and 8, the stock of blanks 16, resting on the supporting fingers 26, is moved downwards together with them under its own weight, until it comes to rest on the residual stock 23 (FIG. 7). The supporting fingers 26 are then retracted to the side out of the region of the blanks (FIG. 8). The lowered stock of blanks 16 now tops up the residual stock 23. The extraction of blanks 10 on the underside by means of the transfer roller 21 is not interrupted during this operation. The supporting fingers return to an upper initial position (the dot-and-dash lines in FIG. 8), in particular in the plane of the magazine table 22, laterally next to the recess 25. As soon as the entire stack of blanks 10, with the exception of the residual stock 23, has been removed (below the plane of the magazine table 24), the magazine 11 is moved transversely in such a way that a magazine shaft with a stock of blanks 16 passes into the position above the extraction station 12. The supporting fingers 26 are previously moved into the position in the region of the recess 25, so that the stock of blanks 16 is supported in the region of the recess 25 (FIG. 3). During the displacement of the magazine 11, the residual stock 23 located underneath the magazine table 24 is reduced, so that a difference in level arises relative to the magazine table 24 (FIG. 3). This must be overcome by means of a controlled lowering of the following stock of blanks 16.

Figure 2:
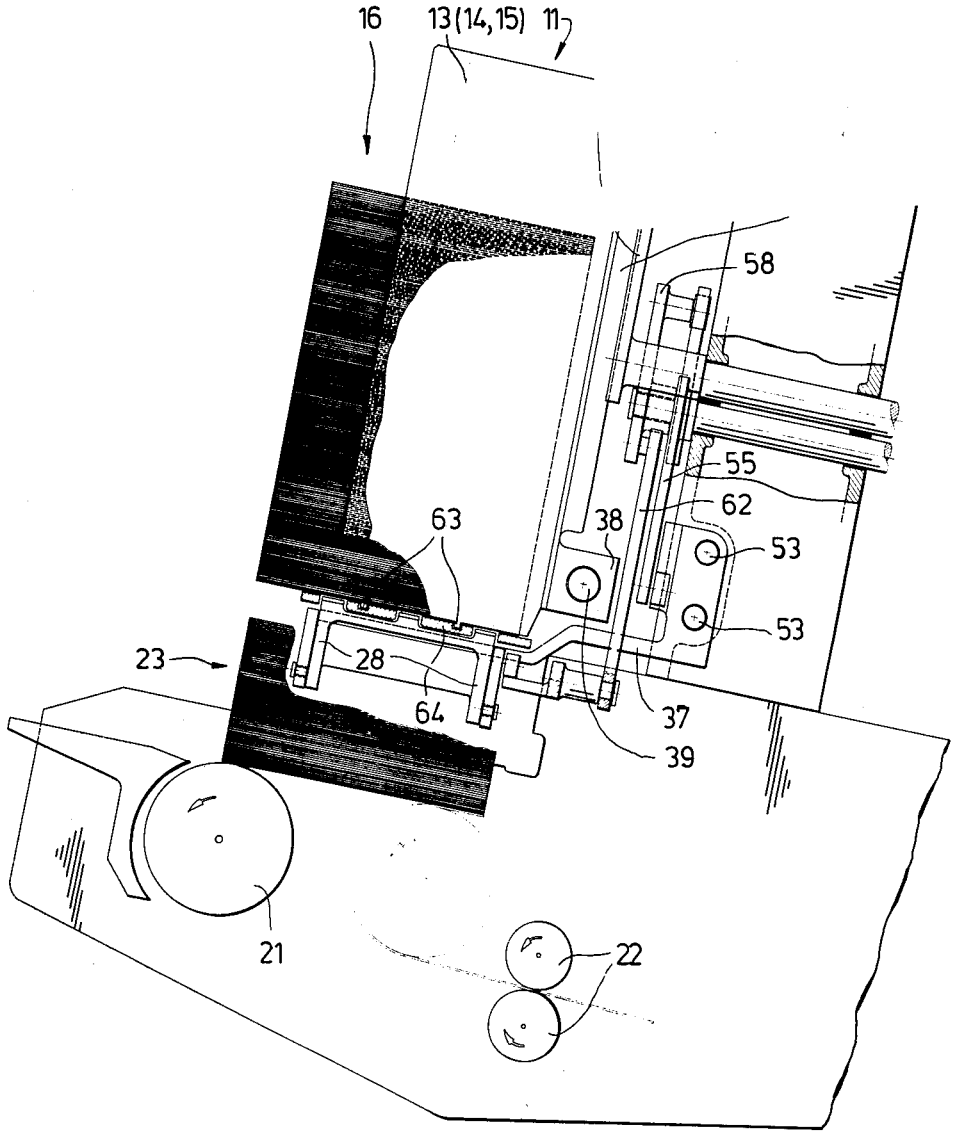
FIG. 2 shows a side view of the magazine on a reduced scale.

In the present exemplary embodiment, the three supporting fingers 26 are connected outside the region of the blanks to a transversely directed supporting member, in particular a cross member 27. The cross member 27 and consequently the supporting fingers 26 are moveable. For this purpose, there are attached to the lateral ends of the cross member 27 vertical supporting webs 28 which are directed essentially downwards and which are connected to a parallelogram linkage consisting of lateral parallalogram links 29, 30. Their free ends in turn are articulated on a linearly displaceable supporting member, in particular a slide 31, or on downward-directed supporting brackets 32 of the latter. As is evident especially from FIG. 2, the slide 31 is arranged laterally outside the region of the magazine 11, in particular at a distance from the rear wall 17 of the latter. The supporting brackets 32 are attached to a bent supporting arm 37 of the slide 31.

The parallelogram links 29, 30 cause a parallel movement of the supporting fingers 26. The controlled up-and-down movement is brought about when the supporting fingers or the parallelogram links 29, 30 rest on a guide member in the form of a supporting plate 33 arranged laterally. This is located outside the range of movement of the supporting fingers 26. Located in the region of a pivot bearing of the (upper) parallelogram link 29 is a supporting roller 34. This rests on the top side of the supporting plate 33. It is moveable in such a way that the supporting fingers 26 together with the parallelogram links 29 and 30 are always held in an essentially horizontal position.

The supporting plate 33 is moveable up and down, in such a way that it can follow the corresponding movements of the supporting fingers 26 or controls these. For this purpose, in the present exemplary embodiment, the supporting plate 33 is attached to a (one-armed) pivotable supporting lever 35 which itself is arranged via a pivot bearing on the underside of the magazine table 24. Pivoting movements of the supporting lever 35 cause a corresponding up-and-down movement of the supporting plate 33 and consequently corresponding movements of the supporting fingers 26. At the same time, the supporting roller 34 allows different relative positions of the supporting fingers 26 in relation to the supporting plate 33. In the upper supporting position (FIG. 3), the supporting lever 35 and consequently the supporting plate 33 are directed essentially horizontally. In the present case, the lower end position of the supporting fingers 26 is defined when a stop 36 comes up against the supporting arm 37 of the slide 31. In the present exemplary embodiment, the stop 36 is designed as an extension of one of the upper parallelogram links 29.

The magazine 11 is displaceable as a single unit by an amount corresponding to the transverse dimension of a magazine shaft 13, 14, 15, in such a way that there is always a particular magazine shaft located in the region of the recess 25 of the magazine table 24, that is to say in the region of the extraction station 12. For this purpose, the magazine 11 is provided with a sliding body 38 arranged on the outside of the rear wall 17 in the lower region. This sliding body is mounted so as to slide on a magazine support rod 39. The latter in turn is anchored at the ends in the machine frame 40.

Figures 4, 5, 6:
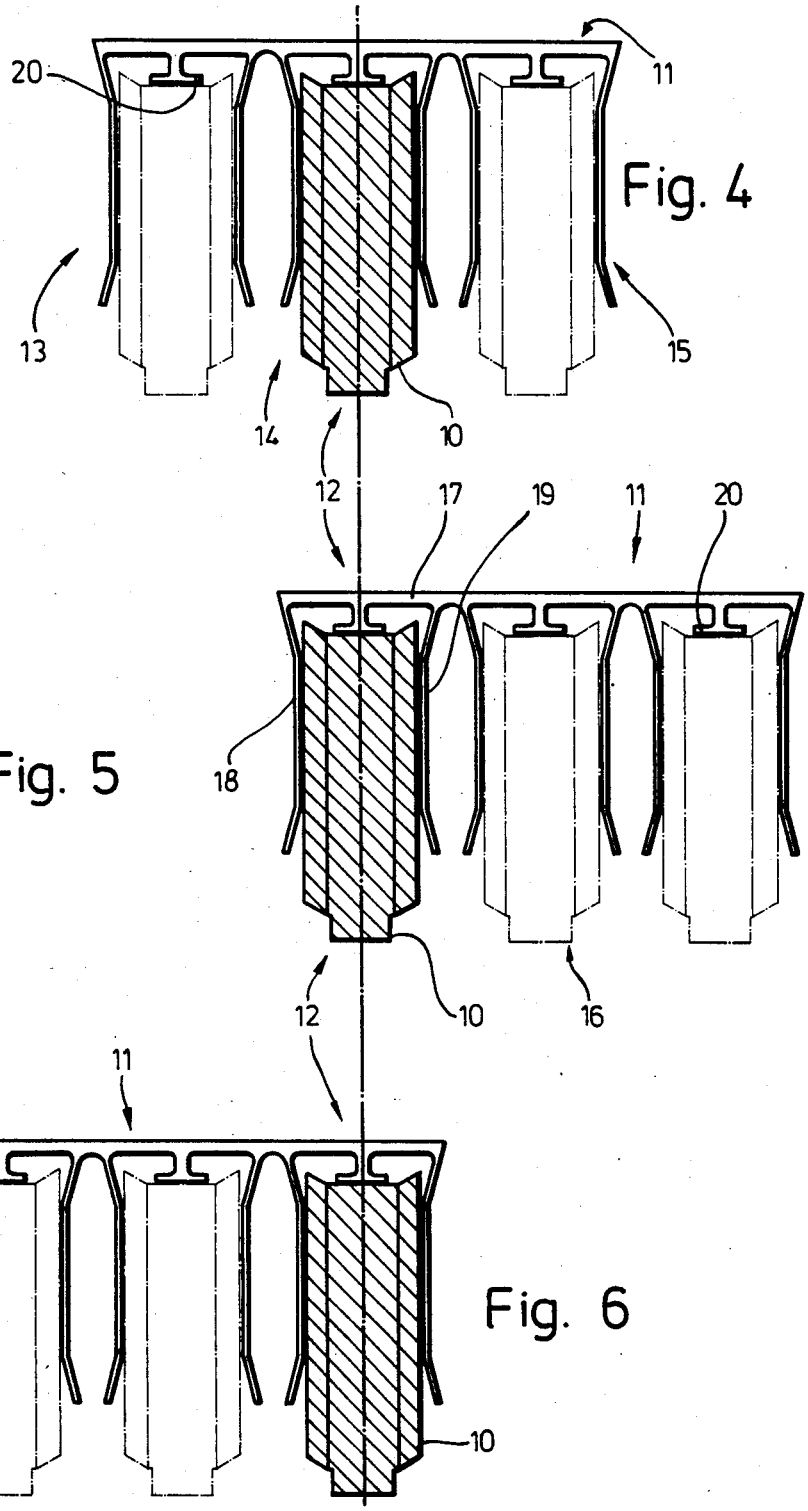
FIGS. 4 to 6 show the magazine in a horizontal projection as a detail in the different relative positions relative to an extraction station.

The magazine 11 is displaceable on the magazine support rod by means of a stepping gear 41. This consists of a disk-shaped driver 42 driven to rotate. The latter engages by means of a depression 43 on the periphery with drive journals 44 of a star wheel 45. The latter is arranged on a drive shaft 46 which is provided at its free end with a crank-like drive arm 47. This is pivoted as a result of the rotation of the drive shaft 46. Located on the end of the drive arm 47 is a drive journal or a drive roller 48. This penetrates into a vertical guide slot 49 in the rear side of the magazine 11 (rear wall 17). Pivoting movements of the drive arm 47 result in a change in the angular position of the latter. As a result, the drive roller 48 slides up and down in the guide slot 49 and at the same time causes the transverse displacement of the magazine 11. The movements are executed periodically, in such a way that stepping movements of the magazine 11 into the alternative positions shown in FIGS. 4 to 6 take place.

The magazine 11 or its rear wall 17 is supported not only on the magazine support rod 39, but also on the opposite upper side, specifically against tilting movements only. Its entire dead weight is absorbed by the magazine support rod 39. The tilting safeguard consists of two supporting rollers 50, 51 arranged at a distance from one another. These are mounted fixedly on a cantilever of the machine frame. Between the supporting rollers 50, 51 located at a distance from one another is received a guide rail 52 of angular crossection, which transmits tilting loads to one supporting roller 50, 51 or the other.

The relative position of the magazine 11 is selected so that it is inclined towards the rear side (rear wall 17) relative to the vertical plane. As a result, the blanks 10 rest against the rear wall 17 in a gently sloping plane.

The movements of the supporting fingers 26, on the one hand, and of the supporting plate 33, on the other hand, are synchronized with one another by means of interacting drives.

The slide 31 for the supporting fingers is mounted displaceably, at a distance from the rear side of the magazine 11, on two sliding rods 53 arranged essentially above one another. The supporting arm 37, extending underneath the plane of the magazine table 24, adjoins the underside of the slide 31. The supporting fingers 26 resting on the supporting arm are in the plane of the magazine table 24, specifically within suitable longitudinal recesses 54 in the latter.

The slide 31 is actuated by a pivoting arm 55 moved to and fro. This penetrates by means of a transmission roller 56 into a vertical guide 57 of the slide 31. A free leg 58 of the pivoting arm 55 is supported by means of a tracer roller 59 on the periphery of a rotating cam disk 60. This is shaped so that pivoting movements for the transverse displacement of the slide 31 are executed in one direction and the other.

The leg 58 is at the same time connected to an actuating arm 61, the free end of which carries an essentially vertical link 62 connected to the supporting lever 35. Pivoting movements of the actuating arm 61, initiated by the cam disk 60 in conjunction with the tracer roller 59 and the leg 58, cause an essentially up-and-down movement of the link 62. This results, in turn, in a corresponding pivoting movement of the supporting lever 35 with the supporting plate 33 for bearing the supporting fingers 26.

The above-described gear is extremely efficient, quick-acting and accurate.

In the present exemplary embodiment, safety measures are taken to prevent (lower) blanks 10 from escaping via a gap between the magazine 11 and the magazine table 24 during the displacement of the magazine 11 relative to the magazine table 24. The vertical side walls 18, 19 of the magazine shafts 13, 14 and 15 are provided with small downward-projecting noses 63 which penetrate into corresponding longitudinal grooves 64 in the magazine table 24.

I claim:

1. In a device for packaging cigarettes in blanks (10) of packaging material stored in a blank storage magazine (11), wherein said magazine comprises:

(a) a plurality of magazine shafts (13,14,15) each for storing a stock (6) of blanks;

(b) an extraction station (12) positioned below said plurality of magazine shafts;

(c) means for horizontally shifting said magazine shafts to bring each of said plurality of magazine shafts, one at a time, in position over said extraction station to discharge its stock of blanks into the extraction station;

(d) a magazine table positioned below the magazine, except in the region of the extraction station, for supporting the stock of blanks in each of the magazine shafts not in position over said extraction station;

(e) moveable support member (26) selectively positioned in the region of the extraction station to prevent entry of blanks from a magazine shaft into the extraction station; and (f) means for lowering said moveable support member (26) into said extraction station and onto a residual stock (23) therein and means for moving said movable support member away from the residual stock to thereby permit the blanks in the magazine shaft to be positioned on the said residual stock within the extraction station so that the residual stock in the extraction station can be refilled.

2. In the device as claimed in claim 1 wherein said moveable support member (26) comprises supporting fingers (26), and further including parallelogram links (29, 30) attached to said supporting fingers for guiding said fingers in parallel movements, the parallelogram links (29, 30) being attached to a supporting slide member (31) moveable to and fro.

3. In the device as claimed in claim 1, wherein said magazine shafts are each open at hte top and bottom thereof, and further including means for shifting said magazine shafts as soon as the magazine shaft located immediately above the extraction station has been emptied.

4. In the device as claimed in claim 1, wherein the magazine (11) consisting of the magazine shafts (13, 14, 15) is made in one piece and is adjustable by means of a stepping gear (41).

5. In a device for packaging cigarettes in blanks (10) of packaging material stored in a blank magazine (11), wherein said magazine comprises:

(a) a plurality of magazine shafts (13, 14, 15) each for storing a stock (16) of blanks;

(b) an extraction station (12) positioned below said plurality of magazine shafts;

(c) means for horizontally shifting said magazine shafts to bring each of said plurality of magazine shafts, one at a time, in position over said extraction station to discharge its stock of blanks into the extraction station;

(d) a magazine table positioned below the magazine, except in the region of the extraction station, for supporting the stock of blanks in each of the magazine shafts not in position over said extraction station;

(e) moveable support member (26) comprising supporting fingers selectively positioned in the region of the extraction station to prevent entry of blanks from a magazine shaft into the extraction station;

(f) means for moving said moveable support member away from the region of the extraction station to thereby permit the blanks in the magazine shaft positioned over the extraction station to enter the extraction station;

(g) means for lowering said supporting fingers onto residual stock (23) in the extraction station (12), and after being lowered onto the residual stock (23) for laterally moving the supporting fingers away from the residual stock; and (h) parallelogram links (29, 30) attached to said supporting fingers for guiding said fingers in parallel movements, the parallelogram links (29, 30) being attached to a supporting slide member (31) moveable to and fro.

6. In the device as claimed in claim 5, wherein the parallelogram links (29, 30) are supported on the side remote from the slide member (31) by a pivotable supporting plate (33) moveable up and down.

7. In the device as claimed in claim 5 further including a cam disc (60) and a pivoting arm (55) means for moving the slide member (31) for the supporting fingers (26) and the pivotable supporting plate (33).

8. In the device as claimed in claim 6, wherein the supporting fingers extend at a distance from one another and are connected to one another, outside the region of the extraction station (12), by means of a cross member (27) which is itself connected to the parallelogram links (29, 30), and further including a supporting roller (34) resting on the supporting plate (33) and being attached laterally to one of the parallelogram links (29).

9. In a device for packaging cigarettes in blanks (10) of packaging material stored in a blank magazine (11), wherein said magazine comprises:

(a) a plurality of magazine shafts (13, 14, 15) each for storing a stock (16) of blanks;

(b) an extraction station (12) positioned below said plurality of magazine shafts;

(c) means for horizontally shifting said magazine shafts to bring each of said plurality of magazine shafts, one at a time, in position over said extraction station to discharge its stock of blanks into the extraction station;

(d) a magazine table positioned below the magazine, except in the region of the extraction station, for supporting the stock of blanks in each of the magazine shafts not in position over said extraction station;

(e) moveable support member (26) comprising supporting fingers selectively positioned in the region of the extraction station to prevent entry of blanks from a magazine shaft into the extraction station;

(f) means for moving said moveable support member away from the region of the extraction station to thereby permit the blanks in the magazine shaft positioned over the extraction station to enter the extraction station;

(g) wherein the magazine shafts (13, 14, 15) are made in one piece and is adjustable by means of a stepping gear (41); and (h) wherein the magazine (11) is mounted in the region of a rear wall (17) so as to be displaceable on a magazine support rod (39) by means of a sliding body (38) and is supported against tilting by means of a guide rail (52) between fixed supporting rollers (50, 51 ).

10. In a device for packaging cigarettes in blanks (10) of packaging material stored in a blank magazine (11), wherein said magazine comprises:

(a) a plurality of magazine shafts (13, 14, 15) each for storing a stock (16) of blanks;

(b) an extraction station (12) positioned below said plurality of magazine shafts;

(c) means for horizontally shifting said magazine shafts to bring each of said plurality of magazine shafts, one at a time, in position over said extraction station to discharge its stock of blanks into the extraction station;

(d) a magazine table positioned below the magazine, except in the region of the extraction station, for supporting the stock of blanks in each of the magazine shafts not in position over said extraction station;

(e) moveable support member (26) comprising supporting fingers selectively positioned in the region of the extraction station to prevent entry of blanks from a magazine shaft into the extraction station;

(f) means for moving said moveable support member away from the region of the extraction station to thereby permit the blanks in the magazine shaft positioned over the extraction station to enter the extraction station;

(g) wherein the magazine shafts (13, 14, 15) are made in one piece and is adjustable by means of a stepping gear (41); and (h) wherein the magazine (11) is moveable transversely by means of the stepping gear (41) via a pivotable drive arm (47) with a drive roller (48), the drive roller (48) penetrating displaceably into vertical guide slot (49) in a rear wall (17) of the magazine (11).

* * * * *